United States Patent [19]

Schneeberger

[11] Patent Number: 4,567,548

[45] Date of Patent: Jan. 28, 1986

[54] CANDLE-SHAPED LUMINARY

[76] Inventor: Peter Schneeberger, Etzmattenstrasse 40, 7800 Freiburg, Fed. Rep. of Germany

[21] Appl. No.: 673,677

[22] Filed: Nov. 21, 1984

[30] Foreign Application Priority Data

Dec. 2, 1983 [DE] Fed. Rep. of Germany ..... 3343595

[51] Int. Cl.[4] ..... F21L 19/00

[52] U.S. Cl. ..... 362/161; 362/101; 362/810

[58] Field of Search ..... 362/161, 209, 34, 101, 362/810, 311, 375

[56] References Cited

U.S. PATENT DOCUMENTS

| | | | |
|---|---|---|---|
| Re. 18,623 | 10/1932 | Root | 362/161 |
| 1,975,496 | 10/1934 | Barrett, Jr. | 362/161 |
| 2,291,072 | 7/1942 | Dahle | 362/161 |
| 2,312,640 | 3/1943 | Guilfoil, Jr. | 362/161 |
| 2,340,527 | 2/1944 | Guilfoil, Jr. | 362/161 |
| 3,890,085 | 6/1975 | Andeweg | 362/161 |
| 4,510,556 | 4/1985 | Johnson | 362/810 |

FOREIGN PATENT DOCUMENTS

| | | | |
|---|---|---|---|
| 271347 | 3/1969 | Austria | 362/161 |
| 1958724 | 6/1971 | Fed. Rep. of Germany | 362/161 |
| 2302775 | 8/1974 | Fed. Rep. of Germany | 362/161 |

*Primary Examiner*—Magdalen Y. C. Moy

*Attorney, Agent, or Firm*—Collard, Roe & Galgano

[57] ABSTRACT

The invention relates to a candle-shaped luminary, primarily intended for use in churches, chapels and other places of worship, which includes a cylindrical pipe, preferably made of a plastic material, with an outer jacket that is provided with a wax, stearin or imitation wax coating. A container of liquid fuel, preferably liquid wax or liquid paraffin, with a wick that extends from the upper side of the container through a wick-guiding tube, is mounted exchangeably inside the pipe. The exchangeable container is provided with an upper cover which corresponds to the width of the pipe, which abuts seamlessly against or on the upper edge of the pipe after the fuel is inserted, resulting in the exact image of the upper front area of a natural candle.

23 Claims, 5 Drawing Figures

Fig.1
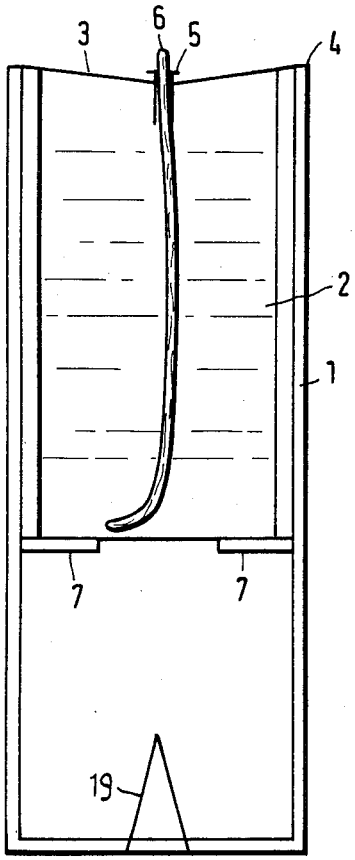
Fig.3
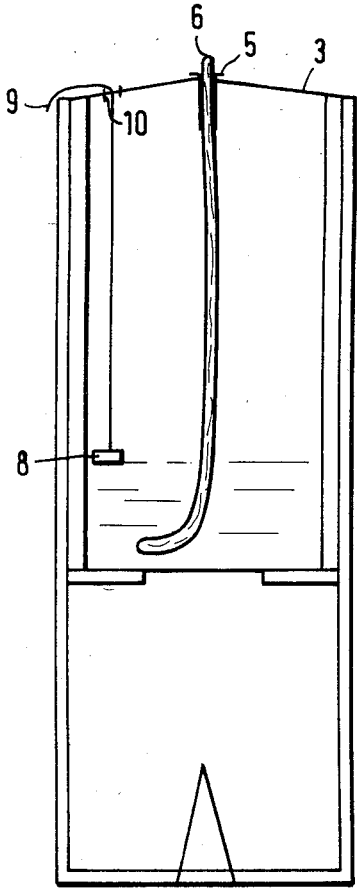
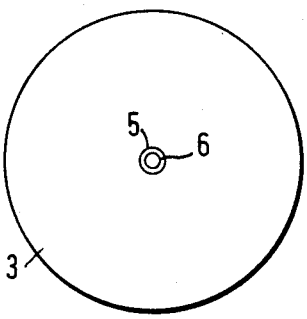
Fig.2

CANDLE-SHAPED LUMINARY

BACKGROUND OF THE INVENTION

The invention relates to a candle-shaped luminary primarily for installation in churches, chapels and other places of worship.

German patent document (DBP) No. 19 58 724 describes a candle-shaped luminary which has a cylindrical pipe generally made of a plastic material whose outer jacket is provided with a wax, stearin or imitation wax coating, which includes a fuel vessel that is transparent, which has the same outer diameter as the cylindrical pipe and can be mounted on the latter.

This candle-shaped luminary is intended to convey the impression that it is a natural candle. At a distance the actual design of the candle-shaped luminary cannot be distinguished from that of a natural candle by the observer. Furthermore, a candle-shaped luminary of this kind is substantially cheaper to manufacture than a normal, large and relatively thick candle.

In the German patent document (DBP) No. 23 02 775, an improved and modified embodiment of the above-described candle-shaped luminary is represented, in which the heat transfer between the actual fuel vessel and the cylindrical body is diminished.

Previously known candle-shaped luminaries, though generally well-suited for their intended purpose, exhibit a drawback resulting from the limited height of the container receiving the fuel. This container being relatively small, thereby necessitates a frequent exchange of the fuel container.

SUMMARY OF THE INVENTION

The object of the present invention is therefore to increase the burning time of the candle-shaped luminary and to facilitate the exchangeability of the fuel container. This object is to be accomplished while continuing to maintain the illusion, from a sufficient viewing distance, that prevents the viewers from distinguishing between the finish of the luminary and a natural candle.

To achieve this object, a candle-shaped luminary with a container or can mounted exchangeably inside the luminary to receive the liquid fuel is proposed. The liquid fuel is preferably liquid wax or liquid paraffin. From the upper side of the container protrudes a wick. The candle-shaped luminary comprises an exchangeable vessel that is connected to an upper cover which approximately corresponds to the width of a pipe and abuts seamlessly against or on the upper edge of the pipe after the fuel vessel is inserted. The result is an exact image of the upper front area of a natural candle.

An important advantage of the invention is that a vessel, of any size, may be filled with a liquid fuel, and with a suitably designed upper cover, can be easily inserted into and removed from the pipe. The luminary will then generate the impression of a natural candle immediately upon insertion of the vessel into the pipe and lighting of the wick.

According to a preferred embodiment of the invention, the upper cover can be made of a translucent material so that the light emanating from the flame will be visible through the cover and the upper edge of the pipe, thereby further enhancing the impression of a burning candle.

The candle-shaped luminary of the present invention is not comparable to the permanent candle of German Utility Model DE GM No. 18 83 839, according to which the upper side of the candle pipe is provided with a lid carrying a guide tube, wherein a candle composition is poured around the pipe and lid. With this permanent candle, the fuel container must be pushed into the pipe from below and brought in agreement with the guide tube in the lid to ensure the entry of the wick inside the guide tube. Using this permanent candle requires that the fuel container be open at the top, at least during insertion into the pipe, a disadvantage in view of the possibility of an outflow or spilling of liquid fuel during insertion.

Other objects and features of the present invention will become apparent from the following detailed description considered in connection with the accompanying drawings. It is to be understood, however, that the drawings are designed as an illustration only and not as a definition of the limits of the invention.

BRIEF DESCRIPTION OF THE DRAWINGS

In the drawings, wherein similar reference characters denote similar elements throughout the several views:

FIG. 1 shows a cross-sectional view of a candle-shaped luminary according to the invention;

FIG. 2 shows a top view of the candle-shaped luminary according to the invention;

FIG. 3 shows a cross-sectional view of a further embodiment of the candle-shaped luminary of the invention.

DETAILED DESCRIPTION OF THE PREFERRED EMBODIMENTS

Figure 4:
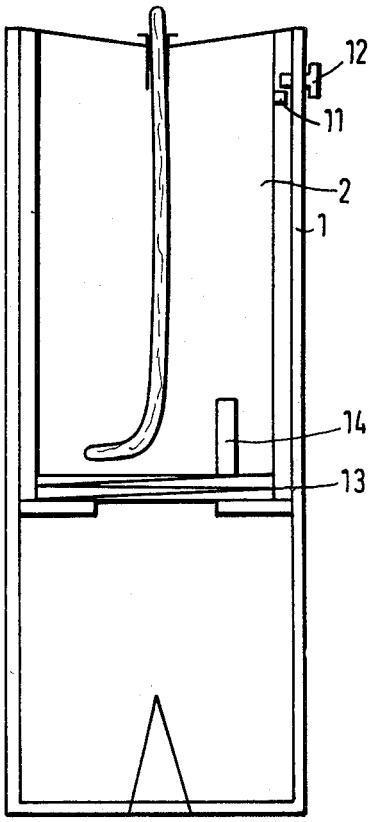
FIGS. 4 and 5 show cross-sectional views of still other embodiments of the candle-shaped luminary of the invention.

As shown in FIG. 1, the candle-shaped luminary of the invention comprises a cylindrical pipe 1, e.g., made of plastic or alabaster, which can be provided on its outside with a wax coating which imparts to pipe 1 the finish of a candle. The bottom side of pipe 1 is enclosed by a cover in which a tapered hole 19 is centrally provided to allow for mounting of the luminary on a candleholder.

Into cylindrical pipe 1 is inserted a container or can 2 to hold the liquid fuel, preferably liquid wax or paraffin. Pipe 1 exhibits on its upper side a cover 3 that reaches beyond the surface line of container 2 and which abuts seamlessly against or on the upper edge 4 of the pipe after container 2 is inserted. The cover thereby represents an exact image of the upper front area of a natural candle.

In the center of cover 3, a wick-guiding tube 5, slightly projecting from the cover, is inserted, through which wick 6 is lead, so as to reach the liquid fuel in the container.

Cover 3 of container 2 is shaped inwardly in a slightly conical shape so as to convey the impression of a partially used candle and make the wick-guiding tube invisible.

Depending on the desired height of the flame, wick 6 can be pulled out from wick-guiding tube 5. The wick-guiding tube is also designed to keep the burning flame at a certain distance from the upper cover. Thus, in case of a strong air current or the like, this will prevent the flame from sitting directly on cover 3 and thus avoid the soiling or sooting of the cover.

The cover is preferably made of a translucent or possibly transparent material, e.g., a suitable plastic.

When pipe 1 is also made of a translucent plastic, the upper range of the edge 4 is shone through by the burning flame, thus enhancing the impression of a burning candle.

In the embodiment shown, the vessel or container 2 is seated on an internal holder 7.

In the embodiment represented in FIG. 3, the upper cover 3 is slightly tapered outwards, so that the candle-shaped luminary conveys the impression of a new candle. To control the filling level of the fuel inside container 2, a small float 8 is arranged therein and is connected to a thread 9 which protrudes from the upper cover 3 through an aperture 10. This will allow one to check the filling level at any time and to exchange the container 2 if necessary. The design of aperture 10 and thread 9 is, of course, unobtrusive so that this arrangement is not recognizable from the distance generally prevailing between the observer and the candle.

FIG. 4 shows an alternative embodiment of the candle-shaped luminary of the invention represented in FIG. 1.

In order to facilitate the removal and exchange of container 2 after the fuel has burnt out, container 2 is provided with a salient 11 which, when inserted, will lock behind a spring-loaded button 12. Container 2 is then pressed into pipe 1 against the pressure of a spring 13 located at the bottom of container 2. When the small, almost undetectable button 12 is pulled out, spring 13 which presses container 2 upwards, allows for the easy removal of the container from the pipe 1. If container 2 is not made of transparent plastic, a small, transparent window 14 can be provided on the backside of the container, away from the viewer, so as to allow one to check the filling level of the liquid fuel.

Figure 5:
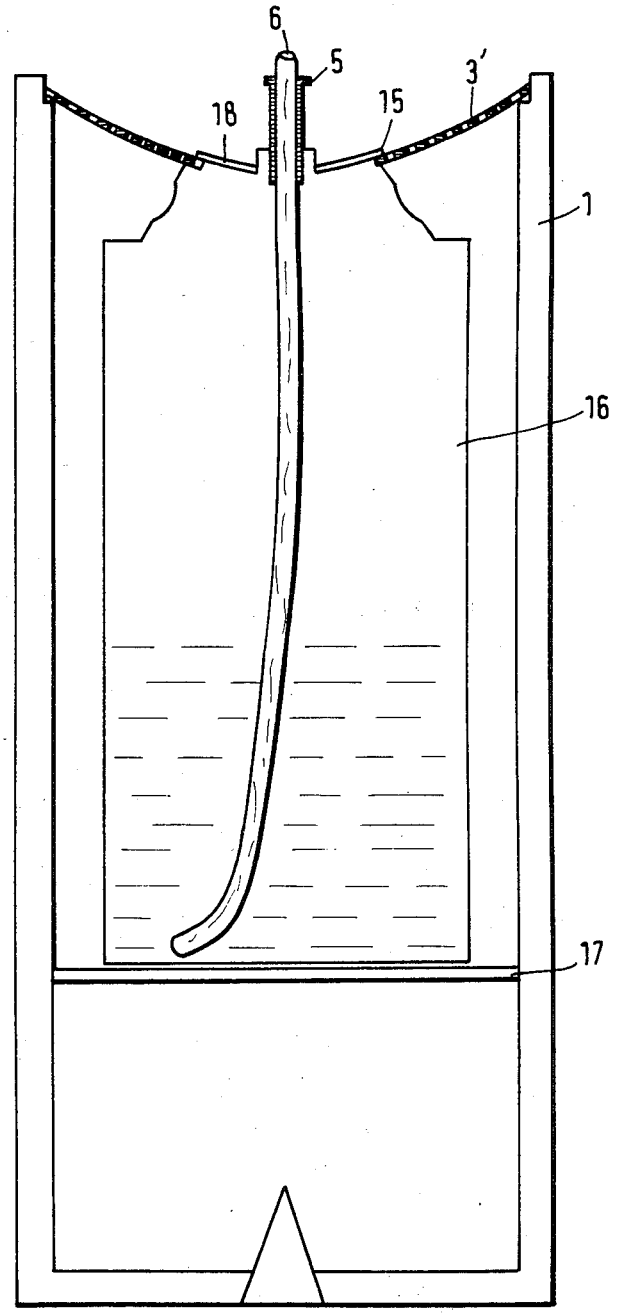

FIG. 5 shows another embodiment of the candle-shaped luminary of the invention. According to this embodiment, the upper cap 3' is fastened to a flange 15 of an especially designed can 16 which is closed at its top. This can, e.g., may exhibit the shape of a customary and well-known spray can. The cap 3', which is a component of the can, is made, e.g., of transparent plastic, into the shape of a transparent plastic disk and fastened to flange 15 by clamping or insertion. This brings about a candle-shaped luminary, that when burning, will shine through upper cap 3', thereby further enhancing the impression of a burning candle. For this purpose, at least the upper portion of pipe 1 is designed as a transparent body. Can 16, countersunk by about 1 cm, is seated on bottom 17 inside pipe 1. The valve disk 18 of can 16, as well as the transparent plastic disk which serves as cap 3', is slightly curved, so that the upper side of the candle-shaped luminary looks like a partially burnt candle.

Wick-guiding tube 5, with wick 6, projects outward from cap 3' by about 1 cm, so that the flame is at about the same height as the upper edge of pipe 1. This results in the upper edge of the candle-shaped luminary becoming translucent. A further advantage of this embodiment is that the flame, because of wick-guiding tube 5, which is about 1 cm high, does not come into contact with the plastic cap and consequently cannot soil the latter on its upper covering edge with soot.

Since can 16 with cap 3', which is fastened to the upper flange, is likely to be industrially-made and delivered, and therefore of a standardized size, the exchanging and insertion of the cans into existing pipes 1 can be performed in a particularly quick and simple manner.

While only a few embodiments of the present invention are shown and described, it will be obvious that many changes and modifications may be made thereunto without departing from the spirit and scope of the present invention.

What is claimed is:

1. A candle-shaped luminary, comprising:

a cylindrical pipe having an outer coating;

a container to receive liquid fuel exchangeably mounted inside of said cylindrical pipe;

an upper cover for said container corresponding to the approximate width of said cylindrical pipe so that said upper cover abuts seamlessly against the upper edge of said pipe after said container is inserted therein; and a wick-guiding tube inserted in said upper cover, and having a wick passing therethrough so that said wick reaches into said container and contacts said liquid fuel, said wick protruding from the upper side of said container that is mounted exchangeably in said pipe, said luminary thereby providing an image of the upper area of a natural candle and an increased burning time.

2. The candle-shaped luminary according to claim 1, wherein said container is inserted into said pipe through the upper end of said pipe.

3. The candle-shaped luminary as defined in claim 1, wherein said outer coating is a wax coating.

4. The candle-shaped luminary as defined in claim 1, wherein said outer coating is a stearin coating.

5. The candle-shaped luminary as defined in claim 1, wherein said outer coating is an imitation wax coating.

6. The candle-shaped luminary as defined in claim 1, wherein said liquid fuel used in said container is liquid wax.

7. The candle-shaped luminary as defined in claim 1, wherein said liquid fuel used in said container is liquid paraffin.

8. The candle-shaped luminary as defined in claim 1, wherein said upper cover is manufactured as a translucent unit.

9. The candle-shaped luminary as defined in claim 1, wherein said upper cover is designed as a transparent unit.

10. The candle-shaped luminary as defined in claim 1, wherein said upper cover projects laterally over said container.

11. The candle-shaped luminary as defined in claim 1, wherein said upper cover exhibits a slightly conical inward design.

12. The candle-shaped luminary as defined in claim 1, wherein said upper cover exhibits a slightly conical outward design.

13. The candle-shaped luminary as defined in claim 1, further comprising a float in said container, said float is provided with a thread which extends through an aperture in said upper cover that reaches into said container to indicate the filling level of said liquid fuel.

14. The candle-shaped luminary according to claim 1, wherein said cylindrical pipe further comprises a spring-loaded pushbutton to engage a corresponding recess in said container so that when said container is inserted into said cylindrical pipe said spring-loaded pushbutton holds said container in said pipe against the pressure of a spring abutting on the underside of said pushbutton.

15. The candle-shaped luminary according to claim 1, wherein said container is designed in the shape of an aerosol spray can with a flange.

16. The candle-shaped luminary according to claim 15, wherein said upper cover is designed as a cap in the shape of a slightly concaved disc which is fastened to said flange of said aerosol-shaped can with a valve disc.

17. The candle-shaped luminary according to claim 16, wherein said upper cover is made of a transparent plastic material.

18. The candle-shaped luminary according to claim 16, further comprising a wick-guiding tube centrally arranged in said valve disc of said can so as to protrude approximately 1 cm from the top of said can to carry said wick.

19. The candle-shaped luminary according to claim 18, wherein said aerosol-shaped can is countersunk by approximately 1 cm from the upper edge of said cylindrical pipe with said aerosol-shaped can arranged on the bottom inside of said cylindrical pipe.

20. An aerosol-shaped can for holding liquid fuel, said liquid fuel to contact a wick projecting from the upper side of said can with a guide tube to guide said wick into said can, comprising:

a valve disc centrally located on the upper side of said can; and a flange at the edge of said valve disc with a plastic disc exhibiting a slightly concave shape fastened to said flange so as to serve as a cap.

21. The can according to claim 20, wherein said can is filled with liquid paraffin fuel.

22. The can according to claim 20, wherein said plastic disc is transparent.

23. The can according to claim 20, wherein said plastic disc is translucent.

* * * * *